US005389499A

United States Patent [19]

Hall

[11] Patent Number: 5,389,499

[45] Date of Patent: * Feb. 14, 1995

[54] PHOTOGRAPHIC MATERIAL HAVING FAITHFUL RENDITION OF THE RED COLOR

[75] Inventor: Jeffrey L. Hall, Rochester, N.Y.

[73] Assignee: Eastman Kodak Company, Rochester, N.Y.

[ * ] Notice: The portion of the term of this patent subsequent to Dec. 14, 2010 has been disclaimed.

[21] Appl. No.: 117,787

[22] Filed: Sep. 8, 1993

Related U.S. Application Data

[62] Division of Ser. No. 816,011, Dec. 30, 1991, Pat. No. 5,270,152.

[51] Int. Cl.[6] ..... G03C 7/20; G03C 7/18

[52] U.S. Cl. ..... 430/359; 430/360; 430/362; 430/504; 430/506; 430/507; 430/508

[58] Field of Search ..... 430/359, 360, 362, 504, 430/506, 507, 508

[56] References Cited

U.S. PATENT DOCUMENTS

| | | | |
|---|---|---|---|
| 2,265,547 | 12/1941 | Schneider | 95/2 |
| 4,306,015 | 12/1981 | Haylett | 430/382 |
| 4,705,744 | 11/1987 | Sasaki et al. | 430/505 |
| 4,729,943 | 3/1988 | Pfaff et al. | 430/362 |
| 5,077,182 | 12/1991 | Sasaki et al. | 430/504 |
| 5,270,152 | 12/1993 | Hall | 430/360 |

FOREIGN PATENT DOCUMENTS

| | | |
|---|---|---|
| 0277644 | 8/1988 | European Pat. Off. . |
| 0296784 | 12/1988 | European Pat. Off. . |

*Primary Examiner*—Richard L. Schilling
*Attorney, Agent, or Firm*—Arthur E. Kluegel

[57] ABSTRACT

A color photographic element which contains a color correction layer above at least one red sensitive layer of the element results in an element having excellent color reproduction.

18 Claims, 3 Drawing Sheets

PHOTOGRAPHIC MATERIAL HAVING FAITHFUL RENDITION OF THE RED COLOR

This application is a divisional of application Ser. No. 07/816,011, filed Dec. 30, 1991, U.S. Pat. No. 5,270,152.

BACKGROUND OF THE INVENTION

This invention pertains to novel photographic elements and to methods of processing such elements. More specifically, the invention relates to color photographic elements which have faithful rendition or reproduction of the red color.

Achieving faithful color rendition is the goal for many color products. One of the factors that influences the ability to faithfully render color in a color negative system is the spectral sensitivity distribution of the silver halide emulsions used in the photographic element. Most color negative photographic elements include at least one blue-sensitive silver halide emulsion layer containing a yellow image dye-forming compound, a yellow filter layer, at least one green sensitive silver halide emulsion layer containing a magenta image dye-forming compound, and at least one red-sensitive layer containing a cyan image dye-forming compound. The structure below represents such a conventional photographic film.

| Structure 1 |
|---|
| OVERCOAT |
| FAST YELLOW |
| SLOW YELLOW |
| YELLOW FILTER LAYER |
| FAST MAGENTA |
| SLOW MAGENTA |
| FAST CYAN |
| SLOW CYAN |
| ANTI HALATION LAYER |
| SUPPORT |

It is known in the art that the spectral sensitivities of these layers overlap, with the largest overlap being the green (and short red) sensitivity of the red-sensitive records. The present inventor has found that faithful color rendition cannot be achieved with this unwanted green light sensitivity of the red-sensitive layers because green light will expose the red-sensitive layers and thus lead to cyan image dye formation when the film is developed. FIG. 1 illustrates the spectral sensitivity of a red-sensitive color record present in a color negative photographic element having a structure as described in Structure 1. The peak sensitivity of this color record occurs at 655 nm. However, it is clear that the red-sensitive record also has sharply increasing green light (and short red) sensitivity from 550 nm to 620 nm as indicated by the cross hatched region in this Figure.

In many color photographic materials, in particular color negative materials, it is now common practice to incorporate in at least one layer of the photographic element, a compound which reacts with the oxidation products of a color developer to release a development inhibiting compound. This development inhibiting compound may inhibit development in the layer in which it was released, that is, have an intralayer effect, or it may diffuse into an adjacent layer and inhibit development, that is, have an interlayer effect.

These development inhibitor releasing compounds known as DIR's in the photographic art, have been proposed to be used in various layers and in various ways in color photographic materials to give both intra- and inter-layer effects. The use of the interlayer restraining effect has been known as a useful means for improving color reproduction of color photographic materials. In color negative photographic materials, for instance, the development restraining effect from the green-sensitive to red-sensitive layers may restrain color formation in the red-sensitive layers and thus help correct the unwanted green sensitivity of the red-sensitive layers when the photographic element is exposed to white light. However, when the exposure is in the 580 to 620 nm range, no corresponding sensitivity of the green-sensitive element is present and therefore there is not suppression of the cyan dye formation by the green-sensitive record. Thus faithful color rendition cannot be achieved by this interimage effect.

U.S. Pat. No. 4,705,744 is directed to a method of improving color reproduction of a photographic material by including an image dye-forming donor layer in the multilayer film. The donor layer contains, in addition to the image dye-forming compound, a silver halide emulsion which is chemically finished and spectrally dyed having a wavelength weighted-average spectral sensitivity at least 5 nm shorter than the wavelength weighted-average spectral sensitivity of the green-sensitive layers, that is, less than 545 nm for the green spectral sensitivity distribution shown in FIG. 1. The donor layer also contains a DIR compound that can act upon the red-sensitive layers.

U.S. Pat. No. 4,306,015 discloses a method of improving color reproduction by including a nonimage dye-forming donor layer in the multilayer. This donor layer also contains a chemically finished and spectrally dyed silver halide emulsion and a DIR compound that leads to low, that is less than ten percent, or no dye formation when the DIR compound reacts with the oxidation products of a color developer. The released inhibitor provides the desired interlayer effects. Recommended peak spectral sensitivities for the donor layer are 670 nm or 520 nm.

However, these donor layers of the prior art do not provide a photographic element having a faithful rendition of red color. The present inventor has found that this is because these donor layers are insufficient in reducing the unwanted green (and short red) sensitivity of the red-sensitive layers of a color sensitivity of the red-sensitive layers of a color photographic element in the spectral region from 550 nm to 620 nm.

Accordingly, there is a need to provide a photographic element having faithful red color rendition. Additionally, there is a need to make efficient use of all light that enters into the photographic element at the time of exposure and, whenever possible, exploit the beneficial interimage effects of the developer inhibitor releasing compounds. Finally, there is a need to control the timing of the release of the development inhibitor releasing compound in order to get faithful rendition of a red color.

SUMMARY OF THE INVENTION

These and other needs have been satisfied by providing a color correction layer substantially free of image dye-forming coupler and which contains a chemically finished and spectrally sensitized photographic silver halide emulsion having a peak sensitivity between about 550 and about 620 nm and optionally a DIR compound, which improves the color reproduction of the multilayer. Such a finding was completely unexpected as the sensitivity of the color correction layer according to the invention is directly contrary to the teachings of the above described U.S. Patents.

In accordance with one aspect of the invention there has been provided a color photographic element comprising:

a) a support bearing at least one photographic silver halide cyan image dye-forming layer, and b) at least one color correction layer substantially free of image dye-forming couplers, comprising a spectrally and chemically sensitized photographic silver halide emulsion having a maximum absorbance wavelength in the range of about 550 to about 620 nm, and, optionally, containing a DIR compound which itself may incidently form a slight amount of nonimage dye, typically the amount of dye formed by the DIR is less than 10% of the total image dye density, wherein at least one of the cyan image dye-forming layers is between the support and at least one of the color correction layers.

In accordance with another object of the invention there has been provided a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, and a color correction nonimage dye-forming layer comprising a spectrally and chemically sensitized photographic silver halide emulsion having a maximum absorbance wavelength in the range of about 550 to about 620 nanometers, optionally containing a DIR compound, wherein at least one of the red-sensitive silver halide emulsion layers is closer to the support than the color correction layer.

There has also been provided a process for developing an image in a photographic element comprising the step of developing said element with a silver halide color developing agent.

There has further been provided a process for improving red color reproduction of a color photographic element comprising at least one blue, at least one green, and at least one red sensitive layer, comprising the steps of incorporating the above described color correction nonimage dye-forming layer in a photographic element, above at least one of the red sensitive layers.

There is also provided a color correction layer for use in photographic elements as described above.

Other objects, features, and advantages of the present invention will become apparent from the detailed description of preferred embodiments that follows.

DETAILED DESCRIPTION OF THE PREFERRED EMBODIMENTS

Figure 1:
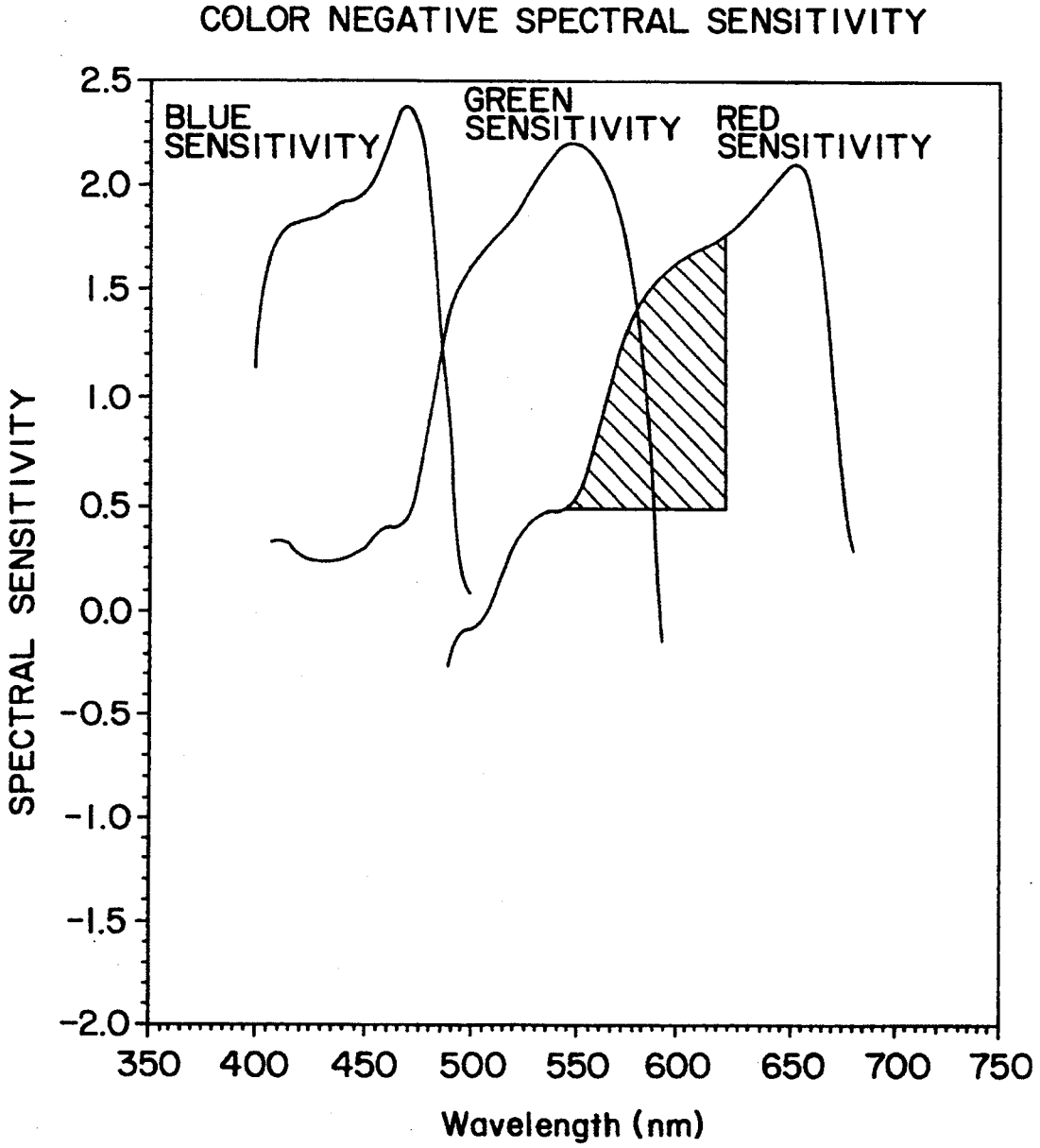
FIG. 1 shows the spectral sensitivity distribution of a photographic element not containing a color correction layer according to the invention.

The color correction layer of the present invention contains a spectrally and chemically sensitized silver halide emulsion having a maximum absorbance wavelength in the range of about 550 to about 620 nm, preferably 560 to 610 nm, and most preferably 570 to 600 nm. The silver halide emulsion is preferably used at a level of about 0.011 to about 1.08 g/m$^2$, more preferably between 0.054 and 0.538 g/m$^2$. As the silver halide emulsion, chemical sensitizers, and spectral sensitizers, used in this layer, any which are known in the art can be used so long as the color correction layer contains the requisite maximum absorbance wavelength which gives the inventive results of a photographic element having faithful reproduction of red color. In the photographic elements according to the invention the non-absorbed long-green-short-red spectral distribution of the exposing light which has a wavelength of from about 550 to about 620 nm, that has passed through the green-sensitive layers, is substantially absorbed by the color correction layer, before this light can expose the red record and contaminate the color quality of the red sensitive layer or layers which are closer to the support than the color correction layer.

Particularly, the silver halide emulsions employed can comprise silver bromide, silver chloride, silver iodide, silver chlorobromide, silver chloroiodide, silver bromoiodide, silver chlorobromoiodide, or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed by Mignot, U.S. Pat. No. 4,386,156; Wey, U.S. Pat. No. 4,399,215; Maskasky, U.S. Pat. No. 4,400,463; Wey et al., U.S. Pat. No. 4,414,306; Maskasky, U.S. Pat. No. 4,414,966; Daubendiek et al., U.S. Pat. No. 4,424,310; Solberg et al., U.S. Pat. No. 4,433,048; Wilgus et al., U.S. Pat. No. 4,434,226; Maskasky, U.S. Pat. No. 4,435,501; Evans et al., U.S. Pat. No. 4,504,570; and Daubendiek et al., U.S. Pat. Nos. 4,672,027 and 4,693,964. Also specifically contemplated are those silver bromoiodide grains with a higher molar proportion of iodide in the core of the grain than in the periphery of the grain, such as those described in U.K. Patent No. 1,027,146; Japanese Patent 544/48521; U.S. Pat. Nos. 4,379,837; 4,444,877; 4,565,778; 4,636,461; 4,665,012; 4,668,614; 4,686,178; and 4,728,602; and in European Patent 264,954. The silver halide emulsions can be either monodisperse or polydisperse as precipitated. The grain size distribution of the emulsions can be controlled by silver halide grain separation techniques or by blending silver halide emulsions of differing grain sizes. Examples of typical emulsions are described in Research Disclosure, Section I–II, December 1989, Item 308119, published by Kenneth Mason Publications Ltd., Emsworth, Hampshire PO10 7DQ, U.K., hereinafter referred to as "Research Disclosure."

A preferred silver halide emulsion consists of about 70 to 100 mole percent of silver bromide with the remainder being silver iodide. The speed of the emulsion can be managed via the chemical sensitization or, more appropriately, by the grain size of the emulsion so as to obtain the desired green-onto-red color correction effect by controlling when the image modifier of the DIR, which is optionally used in the color correction layer, is released. This green-onto-red color correction obtained with the DIR is measured, for the purposes of this application, as the percent change in the contrast of the red-sensitive record when the color correction layer is present relative to the contrast of the red-sensitive record when the emulsion and the DIR are removed from the color correction layer when both multilayers are given neutral exposures. It is thus possible to extend the impact of the color correction layer into the toe of the red-sensitive layer by having the photographic speed of the emulsion used in the color correction layer match the speed of the red-sensitive image dye-forming layer. Alternatively, if a smaller, hence slower, emulsion is used in the color correction layer, the impact on the red-sensitive image dye-forming layer will occur at higher exposures, that is, the upper scale, of the red-sensitive image dye-forming layer.

Useful sensitizing compounds include compounds of copper, thallium, lead, bismuth, cadmium, and Group VIII noble metals. The emulsion can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Any chemical sensitizers known in the art or mixtures thereof can be used. Typical chemical sensitizers are listed in Research Disclosure, Section III. Noble metals, for example, gold; middle chalcogens such as sulfur, selenium, or tellurium; and reduction sensitizers, employed individually or in combination, are specifically contemplated.

The silver halide emulsion of the color correction layer is spectrally sensitized with dyes so as to obtain a maximum absorbance within the range of about 550 to about 620 nm. The dyes can be selected from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Preferred structures include cyanines, complex cyanines, and merocyanines.

Illustrative spectral sensitizing dyes are described in Research Disclosure, Section IV and the publications cited therein. Any sensitizing dye or combination of sensitizing dyes can be used so long as the required maximum absorbance wavelength of about 550 to about 620 nm is obtained.

Preferred spectral dyes identified as SD-1–SD-12 are listed in Table A below. These are typically used at a level of 50 to 100% saturation coverage (a measure of the amount of dye that can adsorb onto the silver halide grain).

TABLE A

Sensitizing Dyes

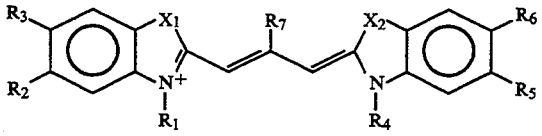

| DYE | $X_1$ | $X_2$ | $R_1$ | $R_2$ | $R_3$ | $R_4$ | $R_5$ | $R_6$ | $R_7$ |
|---|---|---|---|---|---|---|---|---|---|
| SD-1 | —O— | —O— | $-(CH_2)_3SO_3^-$ | —Cl | —H | $-(CH_2)_2CH(SO_3^-)CH_3$ | 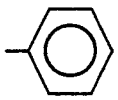 | —H | $-C_2H_5$ |
| SD-2 | $-N(C_2H_5)-$ | $-N(C_2H_5)-$ | $-(CH_2)_2CH(SO_3^-)CH_3$ | —Cl | —Cl | $-(CH_2)_2CH(SO_3^-)CH_3$ | —Cl | —Cl | —H |
| SD-3 | —Se— | —O— | $-C_2H_5$ | $-OCH_3$ | —H | $-(CH_2)_2CH(SO_3^-)CH_3$ | 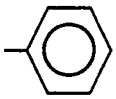 | —H | $-C_2H_5$ |
| SD-4 | —S— | —O— | $-CH_2C(=O)NH(SO_2CH_3)$ | —H | —H | $-C_2H_5$ | 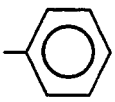 | —H | $-C_2H_5$ |
| SD-5 | —S— | —O— | $-C_2H_5$ | —H | —H | $-(CH_2)_2CH(SO_3^-)CH_3$ | 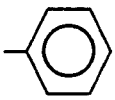 | —H | $-C_2H_5$ |

TABLE A-continued

Sensitizing Dyes

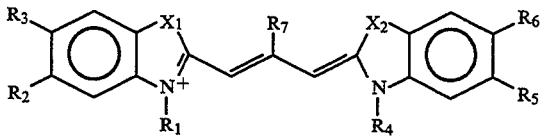

| DYE | $X_1$ | $X_2$ | $R_1$ | $R_2$ | $R_3$ | $R_4$ | $R_5$ | $R_6$ | $R_7$ |
|---|---|---|---|---|---|---|---|---|---|
| SD-6 | —Se— | —O— | $-(CH_2)_2CH(SO_3^-)CH_3$ | —H | —H | $-CH_3$ | 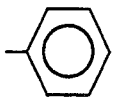 | —H | $-C_2H_5$ |
| SD-7 | —S— | —O— | $-(CH_2)_2C(=O)O^-Na^+$ | —H | —H | $-(CH_2)_3SO_3^-$ | —Cl | —H | $-C_2H_5$ |
| SD-8 | —S— | —O— | $-C_2H_5$ | $-OCH_3$ | —H | $-(CH_2)_3SO_3^-$ | $-CH_3$ | —H | $-C_2H_5$ |
| SD-9 | —S— | —O— | $-(CH_2)_3SO_3^-$ | $-OCH_3$ | $-OCH_3$ | $-(CH_2)_2CH(CH_3)SO_3^-$ | 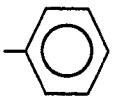 | —H | $-C_2H_5$ |
| SD-10 | —O— | —Se— | $-(CH_2)_3SO_3^-$ | —Cl | —H | $-(CH_2)_3SO_3^-$ | —Cl | —H | $-C_2H_5$ |
| SD-11 | —S— | —S— | $-(CH_2)_3SO_3^-$ | —Cl | —H | $-(CH_2)_3SO_3^-$ | —Cl | —H | $-C_2H_5$ |
| SD-12 | 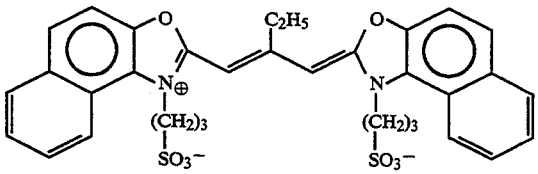 | | | | | | | | |
| SD-13 | 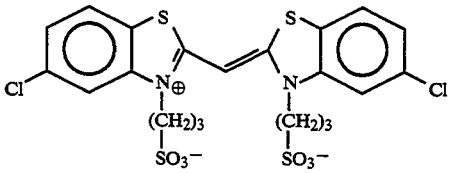 | | | | | | | | |

The light absorbed by the emulsion of the color correction layer can be utilized during the development reaction. Particularly, during development the recorded latent image is converted to metallic silver and the generated oxidized developing agent can then be used for in-situ release of an image modifying agent from an incorporated development inhibitor releasing compound. That is, since silver halide is used to capture the incident photon, the captured photon can be used to do work. Specifically, if the layer contains development inhibitor releasing compounds, an inhibitor can be released from the compound by use of the captured photon.

Accordingly, the color correction layer according to the invention can optionally contain a development inhibitor releasing compound. An image modifier need not be used if the filtration effect of the sensitized emulsion of the color correction layer is sufficient to balance the green sensitivity of the red record with its desired red sensitivity. However, if there is desired more green-onto-red interimage for sharpness or color reproduction, then an image modifier is beneficially incorporated into the correction layer.

Any DIR which is known in the art, or mixtures of such DIR's, can be used as a component of the color correction layer. Such DIR's are described in, for example, the following patents and publications:

U.S. Pat. No. 3,227,554; U.S. Pat. No. 3,384,657; U.S. Pat. No. 3,615,506; U.S. Pat. No. 3,617,291; U.S. Pat. No. 3,733,201; U.S. Pat. No. 4,248,962; U.S. Pat. No. 4,409,323; U.S. Pat. No. 4,546,073; U.S. Pat. No. 4,564,587; U.S. Pat. No. 4,618,571; U.S. Pat. No. 4,684,604; U.S. Pat. No. 4,698,297; U.S. Pat. No. 4,737,452; U.S. Pat. No. 4,782,012; U.S. Pat. No. 5,006,448; U.S. Pat. No. 5,021,555; U.S. Pat. No. 5,034,311; EP 255,085; EP 348,139; U.K. 1,450,479; and U.K. 2,099,167.

Such DIR's are generally of the formula:

CAR-PUG or, alternatively, CAR-LINK-PUG wherein

PUG is a releasable group which acts as a development inhibitor during processing, CAR is a carrier moiety that, upon reaction with oxidized color developing agent, is capable of releasing PUG or LINK-PUG, LINK is a timing group which is releasable from CAR during photographic processing and subsequently releases PUG.

As the timing group, any such group that is known in the art can be used. Examples of useful timing groups are described in, for example, U.S. Pat. Nos. 4,248,962; 4,409,323; 5,034,311; and 5,026,628, and European Patent Application 255,085.

The particular timing group employed, including the linkage by which they are attached to the CAR and the PUG, and the nature of the substituents on the timing group, can be varied to help control such parameters as rate and time of bond cleavage of the CAR, as well as diffusibility of the PUG.

Upon reaction with oxidized developing agent, the linking group may be stable or unstable after reaction. Alternatively, the linking group may form part of the PUG nucleus; in other words, the entire linking group or a portion thereof may or may not cleave from the PUG.

CAR is preferably a coupler moiety to whose coupling position LINK-PUG is attached, so that it is coupled off by reaction with oxidized color developing agent formed in an imagewise manner as a function of silver halide development. CAR can be a cyan, magenta, or yellow dye-forming coupler. The CAR can also be a coupler moiety which yields colorless products upon reaction with oxidized developing agents. Useful CAR groups are described in, for example, U.S. Pat. Nos. 5,026,628 and 5,034,311 which are hereby incorporated by reference.

The CAR, particularly when it is a coupler moiety, can be unballasted or ballasted with an oil-soluble or fat-soluble tail group. It can be monomeric, or it can form part of a dimeric, oligomeric, or polymeric CAR.

Suitable development inhibitors are disclosed in U.S. Pat. No. 5,026,628, which is hereby incorporated by reference. Specific reference is made to column 8, line 43 through column 10, line 23. Examples of DIR's are shown in Table B.

TABLE B

DEVELOPMENT INHIBITOR RELEASING COMPOUND

D-1

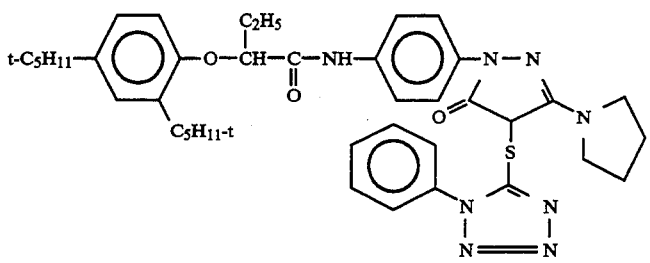

D-2

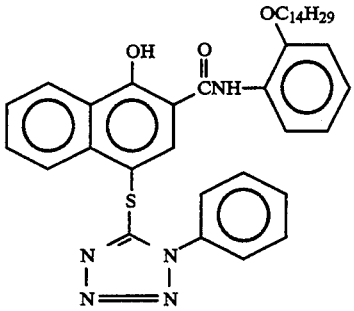

D-3

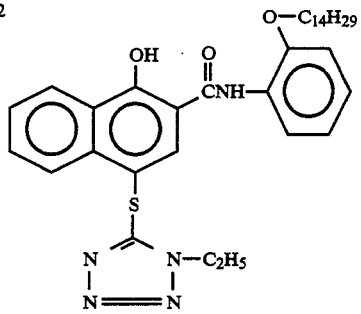

D-4

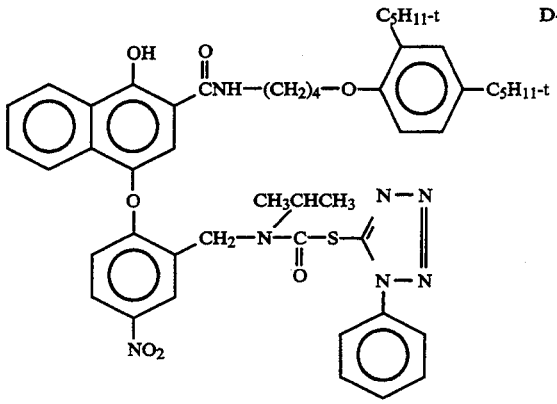

D-5

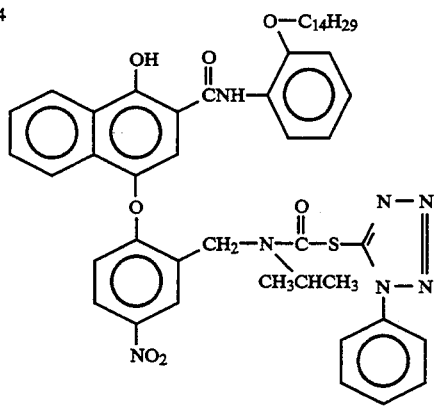

TABLE B-continued
DEVELOPMENT INHIBITOR RELEASING COMPOUND
D-6
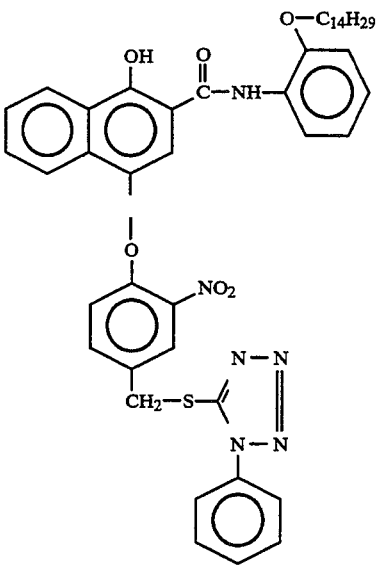
D-7
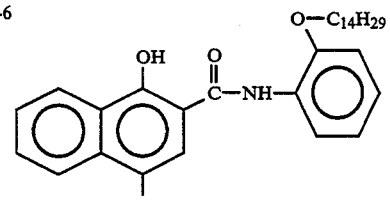
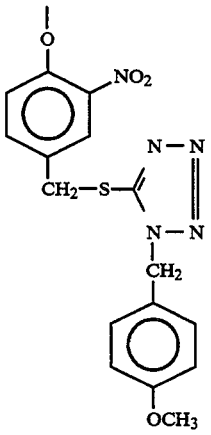
D-8
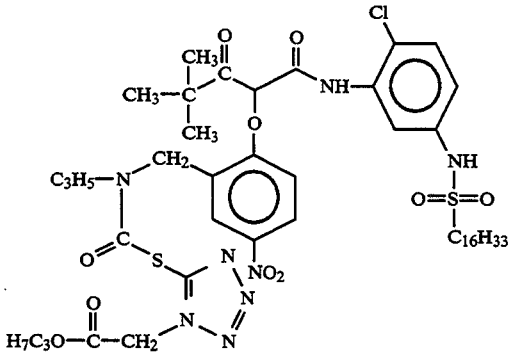
D-9
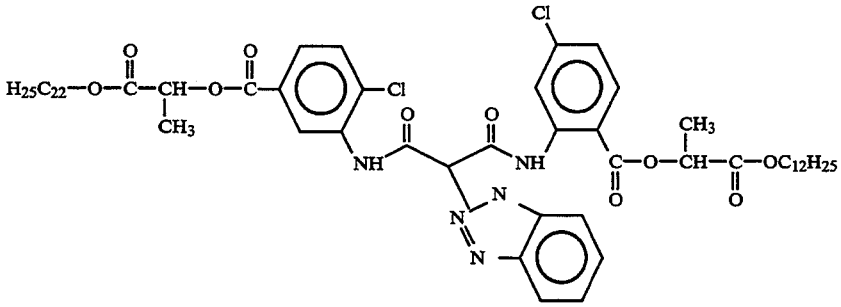

TABLE B-continued

DEVELOPMENT INHIBITOR RELEASING COMPOUND

D-10

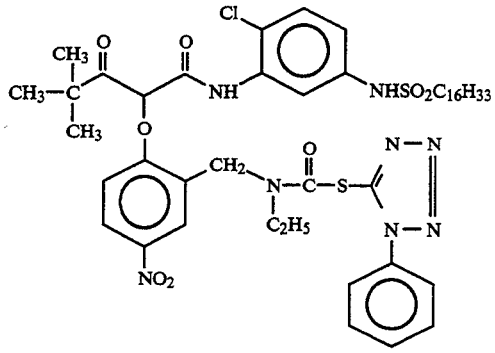

D-11

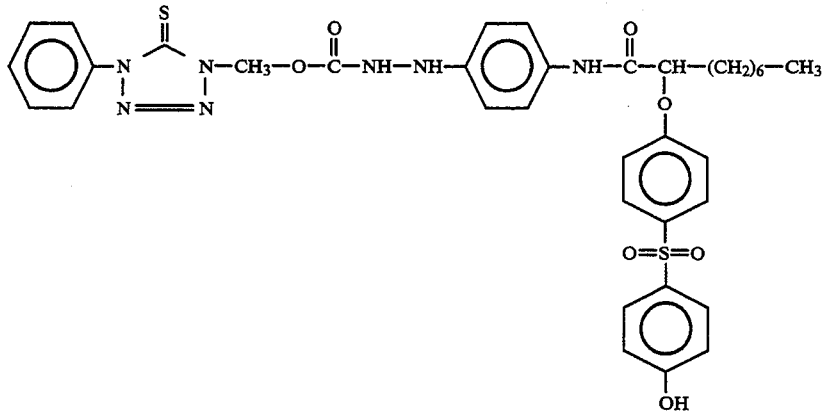

D-12

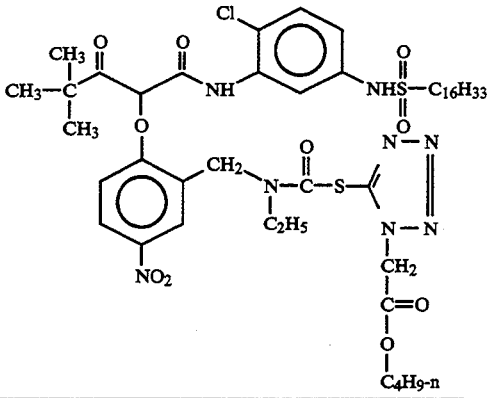

The proportions of ingredients in the color correction layer can be varied within a wide range so long as the necessary maximum wavelength absorbance is maintained. The size of the emulsion, the level, type, and absorptance profile of the sensitizing dye or dyes, and the amount, the release profile and strength of the DIR can be adjusted so as to obtain optimum effective spectral sensitization of the color correction layers at the time of exposure and optimum interlayer interimage effects during development.

The amount of DIR in the color correction layer can be selected so as to obtain the desired interimage while maintaining the desired improved red color rendition with the color correction layer absorbing unwanted green light. A preferred level ranges from about 0.011 to about 0.269 g/m$^2$, more preferably between 0.011 to 0.108 g/m$^2$.

The color correction layer described above can be located at any point of a color photographic element such that at least one red sensitive layer is between the correction layer and the support. The color correction layer is above at least one red sensitive layer so that the unwanted green absorption of the underlying red sensitive layer is reduced or eliminated. The location of the layer can be chosen so as to obtain optimum color reproduction of the element by reducing the unwanted green sensitivity of the red-sensitive layers. Preferably the photographic element is of the structure shown above as "Structure 1" with the color correction layer located between the slow magenta and fast cyan layers, or between the fast cyan and slow cyan layers. The advantage of placing the color correction layer between the fast and the slow red-sensitive layer is that the impact of the development inhibitor releasing compound is maximized if it is located immediately adjacent to both red-sensitive cyan image dye-forming layers. Preferably, the color correction layer is located between the least sensitive green-sensitive layer and the most sensitive red-sensitive layer, or between the most sensitive red-sensitive layer, and the next most sensitive red-sensitive layer.

The multicolor photographic element according to the invention preferably contains at least two blue sensitive layers, at least two green sensitive layers, and at least two red sensitive layers. The couplers used in the layers can be any known in the art, so long as the desired sensitivity is obtained. Preferred constituents of the various layers of the film are shown in the examples, described hereinafter.

In the following discussion of suitable materials for use in the emulsions and elements according to the invention, reference will be made to the Research Disclosure, cited earlier. The elements of the invention can comprise emulsions and addenda described in these publications and publications referenced therein.

The silver halide emulsions employed in the elements according to the invention are described above in connection with the color correction layer. The emulsions may comprise chemical sensitizers and spectral sensitizers, which also are discussed above.

Suitable vehicles for the emulsion layers and other layers of elements according to the invention are described in Research Disclosure, Item 17643, Section IX and the publications cited therein.

The photographic elements according to the invention can include additional couplers such as those described in Research Disclosure Section VII, paragraphs D–G and the publications cited therein. These additional couplers can be incorporated as described in Research Disclosure Section VII, paragraph C and the publications cited therein. The coupler combinations according to the invention can be used with colored masking couplers such as described in U.S. Pat. No. 4,883,746, with image modifying couplers such as described in U.S. Pat. Nos. 3,148,062; 3,227,554; 3,733,201; 4,409,323; and 4,248,962 and with couplers that release bleach accelerators such as described in European Patent Application 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, additional interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine di-p-toluenesulfonic acid.

With negative-working silver halide, the process step described above leads to a negative image. The described elements are preferably processed in the known C-41 color process as described in, for example, the British Journal of Photography Annual of 1988, pages 196–198. To obtain a positive (or reversal) image, the color development step can be preceded by development with a non-chromogenic developing agent to develop exposed silver halide, but not form dye, and then uniformly fogging the element to render unexposed silver halide developable, followed by development with a chromogenic developer. Alternatively, a direct-positive emulsion can be employed to obtain a positive image.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid or ferric 1,3-propylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

EXAMPLES

The couplers and UV absorbers used in examples 1–5 are disclosed in Table C. The DIR's and sensitizing dyes are selected from those of Tables B and A respectively, as indicated.

TABLE C
COUPLER & UV STRUCTURES
C-1
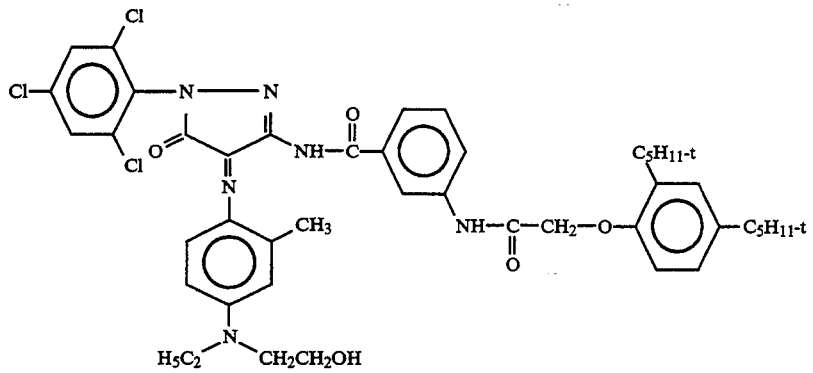
C-2
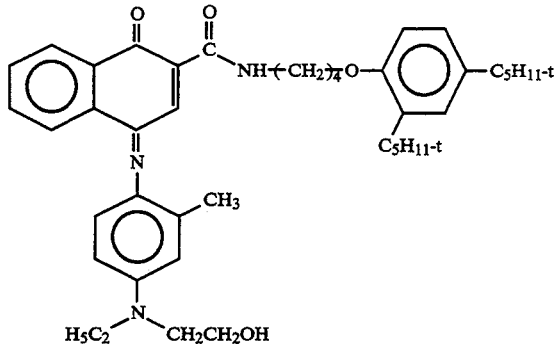
C-3
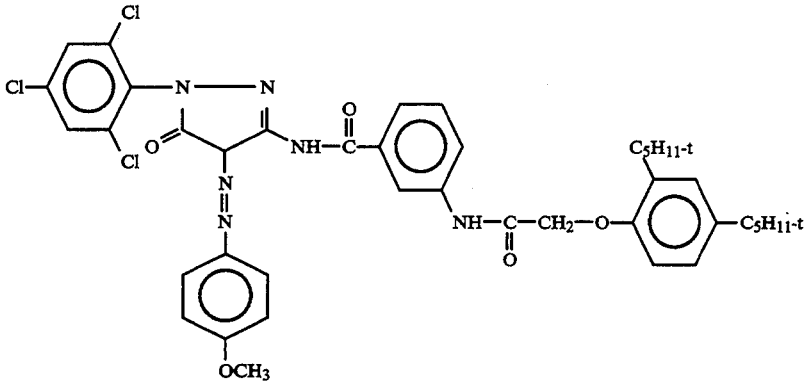
C-4
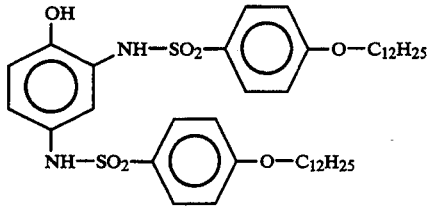
C-5
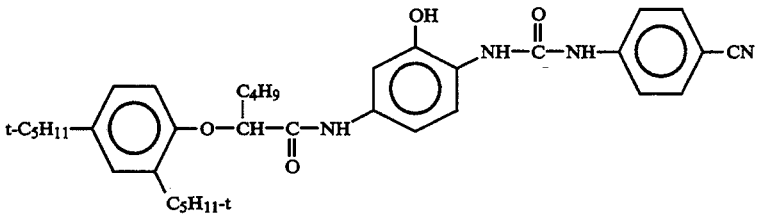

TABLE C-continued

COUPLER & UV STRUCTURES

C-6

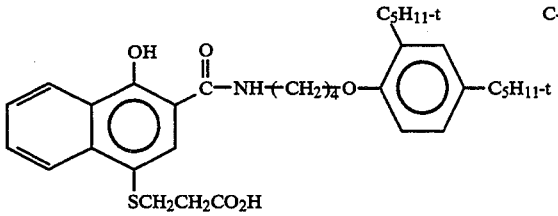

C-7

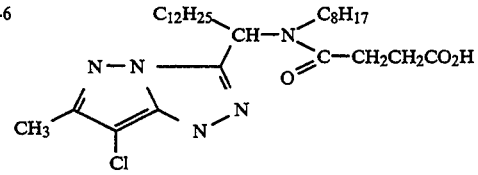

C-8

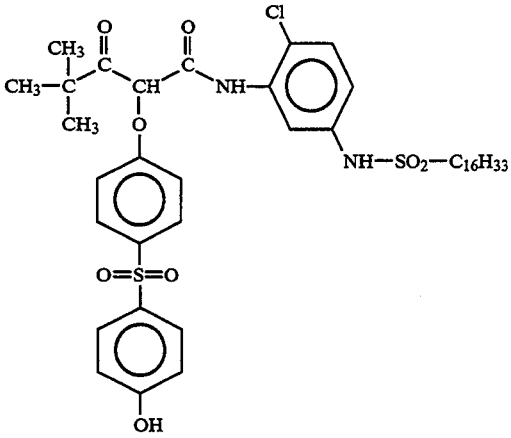

C-9

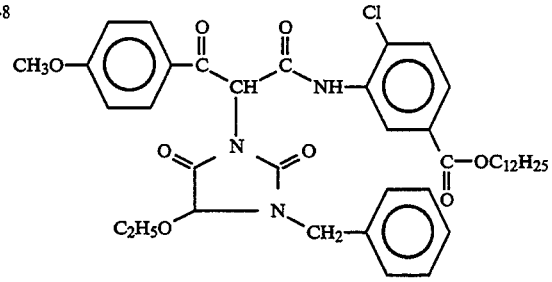

UV-1

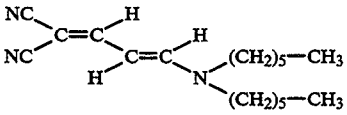

UV-2

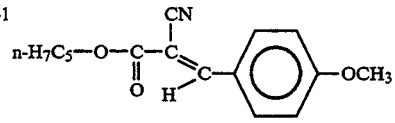

In the examples, a series of multilayer color negative films were made having the following structure. The layers are numbered in order, layer 1 being nearest the film support.

| | |
|---|---|
| Layer 1, Antihalation Layer: | |
| Black filamentary silver | 0.27 g/m$^2$ |
| UV-1 | 0.08 g/m$^2$ |
| C-1 | 0.02 g/m$^2$ |
| C-2 | 0.02 g/m$^2$ |
| C-3 | 0.04 g/m$^2$ |
| C-4 | 0.05 g/m$^2$ |
| Gelatin | 2.42 g/m$^2$ |
| Layer 2, First red-sensitive layer: | |
| Slow AgBr/I emulsion comprising a first slow AgBr/I tabular grain (T-grain) emulsion containing 1.3 mole % iodide with dimensions of 0.5 × 0.08 micron (ecd or equivalent circular diameter by thickness) and a Second slow AgBr/I T-grain emulsion containing 3 mole % iodide, 1.0 × 0.11 microns | 1.62 g/m$^2$ |
| SD-9 | 1.24 × 10$^{-4}$ moles/mole silver |
| SD-11 | 1.46 × 10$^{-3}$ moles/mole silver |
| C-5 | 0.81 g/m$^2$ |
| D-7 | 0.03 g/m$^2$ |
| D-3 | 0.03 g/m$^2$ |
| C-6 | 0.09 g/m$^2$ |
| Gelatin | 2.69 g/m$^2$ |
| Layer 3, Second red-sensitive layer: | |
| Fast AgBr/I emulsion | 0.97 g/m$^2$ |

-continued

| | |
|---|---|
| comprising a Fast AgBr/I T-grain emulsion containing 3 mole % iodide, 1.5 × 0.12 microns | |
| SD-9 | 7.50 × 10$^{-5}$ moles/mole silver |
| SD-11 | 8.71 × 10$^{-4}$ moles/mole silver |
| C-5 | 0.24 g/m$^2$ |
| D-7 | 0.08 g/m$^2$ |
| D-3 | 0.05 g/m$^2$ |
| D-2 | 0.03 g/m$^2$ |
| Gelatin | 1.85 g/m$^2$ |
| Layer 4, Interlayer: | |
| C-4 | 0.05 g/m$^2$ |
| Gelatin | 0.86 g/m$^2$ |
| C-4 is a ballasted and therefore immobile oxidized developer scavenger. | |
| Layer 5, First green-sensitive layer: | |
| Slow AgBr/I emulsion comprising a first slow AgBr/I T-grain emulsion containing 1.3 mole % iodide, 0.5 × 0.08 micron, a second slow AgBr/I T-grain emulsion containing 1.5 mole % iodide, 1.0 × 0.09 micron, and a third slow AgBr/I T-grain emulsion containing 3 mole 4 iodide, 1.25 × 0.12 micron | 1.22 g/m$^2$ |
| SD-1 | 1.26 × 10$^{-3}$ moles/mole silver |
| SD-12 | 4.30 × 10$^{-4}$ moles/mole silver |
| C-7 | 0.39 g/m$^2$ |
| Gelatin | 1.26 g/m$^2$ |
| Layer 6, Second green-sensitive | |

-continued

| | |
|---|---|
| layer: | |
| Fast AgBr/I emulsion comprising a Fast AgBr/I T-grain emulsion containing 3 mole % iodide, 1.25 × 0.12 micron | 0.97 g/m$^2$ |
| SD-1 | 7.09 × 10$^{-4}$ moles/mole silver |
| SD-12 | 2.38 × 10$^{-4}$ moles/mole silver |
| C-7 | 0.14 g/m$^2$ |
| D-1 | 0.03 g/m$^2$ |
| Gelatin | 1.24 g/m$^2$ |
| Layer 7, Yellow filter layer: | |
| Yellow silver | 0.04 g/m$^2$ |
| C-4 | 0.05 g/m$^2$ |
| Gelatin | 0.86 g/m$^2$ |
| Layer 8, First blue-sensitive layer: | |
| Slow AgBr/I emulsion comprising a first slow AgBr/I T-grain emulsion containing 1.3 mole % iodide, 0.5 × 0.08 micron and a second slow AgBr/I emulsion containing 3 mole % iodide, 0.65 × 0.42 micron | 0.54 g/m$^2$ |
| SD-13 | 1.732 × 10$^{-3}$ moles/mole silver |
| C-9 | 0.86 g/m$^2$ |
| D-8 | 0.08 g/m$^2$ |
| Gelatin | 1.66 g/m$^2$ |
| Layer 9, Second blue-sensitive layer: | |
| Fast AgBr/I emulsion comprising a Fast AgBr/I emulsion containing 7.5 mole % iodide, 1.0 × 0.35 micron | 0.65 g/m$^2$ |
| SD-13 | 5.58 × 10$^{-4}$ moles/mole silver |
| C-8 | 0.25 g/m$^2$ |
| D-8 | 0.05 g/m$^2$ |
| Gelatin | 1.29 g/m$^2$ |
| Layer 10, Ultraviolet protective layer: | |
| AgBr Lippmann emulsion | 0.22 g/m$^2$ |
| UV-1 | 0.11 g/m$^2$ |
| UV-2 | 0.11 g/m$^2$ |
| Gelatin | 0.54 g/m$^2$ |
| Layer 11, Protective gelatin overcoat: | |
| Polymethylmethacrylate | 0.05 g/m$^2$ |
| Gelatin | 0.89 g/m$^2$ |

Sensitizing dye structures are given in Table A, coupler and UV structures are given in Table C, and development inhibitor releasing compounds are given in Table B.

Example 1 as described above. This is a comparative example not containing the inventive CCL.

Example 2

Same as example 1 except layer 4 additionally comprises:

| | | |
|---|---|---|
| a) | Fast AgBr/I T-grain emulsion-comprising 3 mole % of iodide, 1.8 × 0.12 micron | 0.43 g/m$^2$ |
| b) | SD-S | 1.2 × 10$^{-3}$ moles/mole silver |
| c) | SD-S | 1.2 × 10$^{-3}$ moles/mole silver |

Example 3

Same as example 2 except layer 4 additionally comprises:

| | | |
|---|---|---|
| a) | D-1 | 0.06 g/m$^2$ |

Example 4

Same as example 1 except layer 4 additionally comprises:

| | | |
|---|---|---|
| a) | Fast AgBr/I T-grain emulsion containing 3 mole % of iodide, 1.8 × 0.12 micron | 0.43 g/m$^2$ |
| b) | SD-1 | 7.09 × 10$^{-4}$ moles/mole silver |
| c) | SD-12 | 2.38 × 10$^{-4}$ moles/mole silver |
| d) | D-1 | 0.06 g/m$^2$ |

Example 5

Same as example 1 except for the following modification:

a) Insert the color correction layer of example 3 between layer 2 and layer 3.

Results

FIG. 1 shows the spectral sensitivity distribution of Example 1. The spectral sensitivity is defined as the log exposure value obtained at a density corresponding to Dmin+0.30 from wavelength dependent exposures. These log exposure values are corrected for an equi-energy exposing source. The unwanted long-green-short-red sensitivity of the cyan emulsions is evident in the wavelength range from 550 nm to 620 nm.

Figure 2:
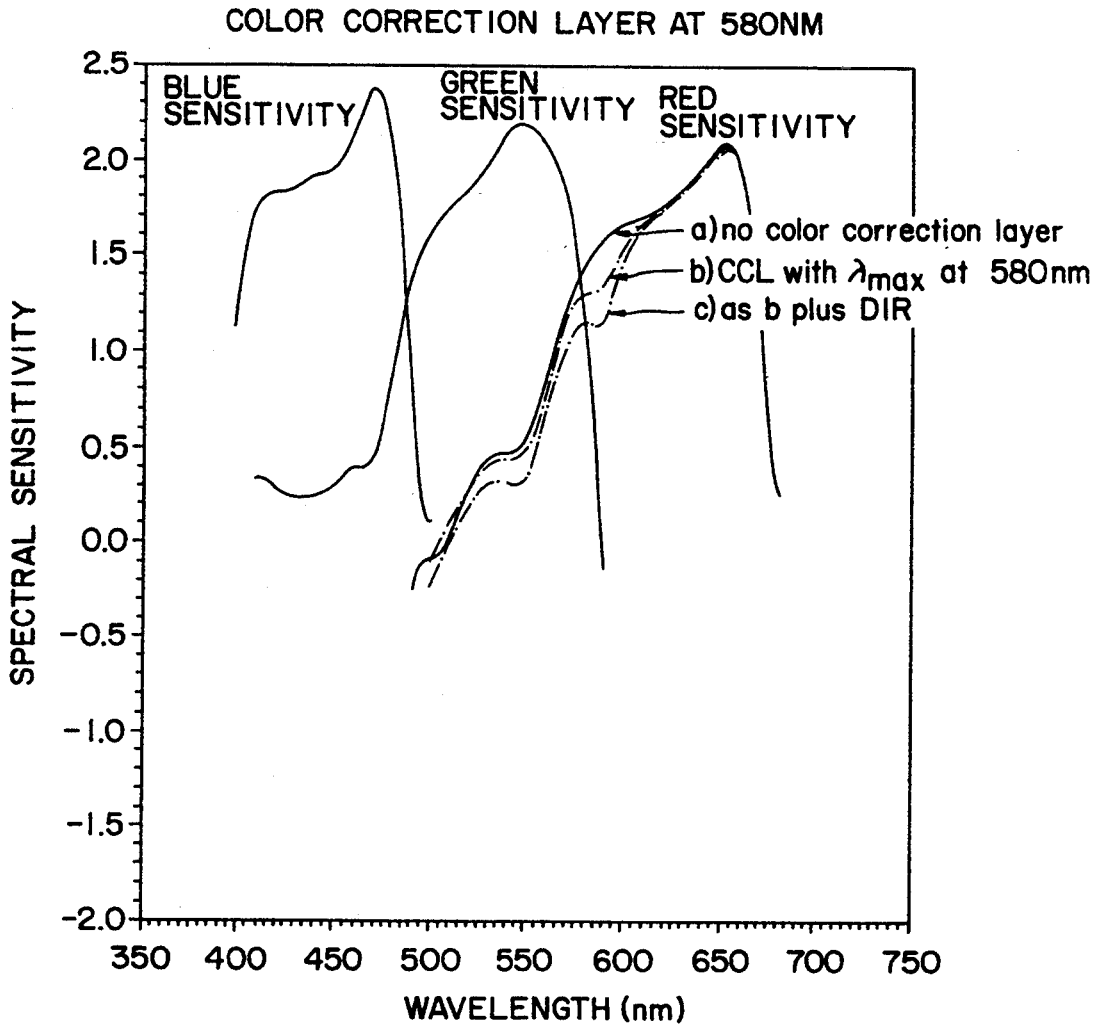
FIGS. 2 and 3 show the improvements in the spectral sensitivity distribution of a photographic element achieved according to the invention.

FIG. 2(*b*) shows the spectral sensitivity distribution of the invention when the color correction layer is as described in Example 2. The spectral sensitivity of the red record is reduced in the spectral region from 550 nm to 620 nm. The peak sensitivity of the color correction layer occurs, by inference from these plots, at 580 nm. As shown in FIG. 2(*c*) the sensitivity of the red record is further depressed in this spectral region when the development inhibitor releasing compound is added to the layer as in Example 3 including exposures at wavelengths between 575 nm and 620 nm wherein the green sensitive layer remains unexposed.

Figure 3:
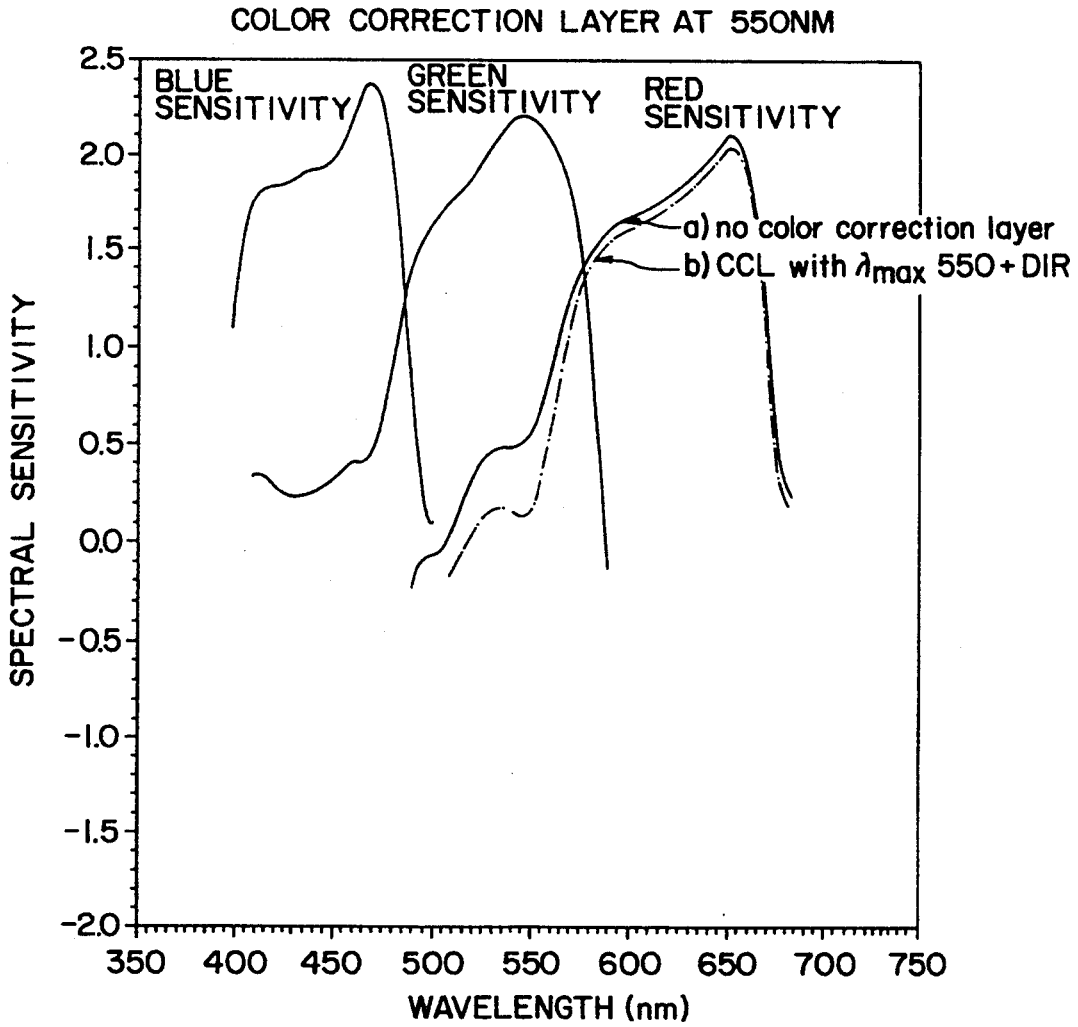

FIG. 3(*b*) shows that there is a lowering of the spectral sensitivity distribution for the red record when the spectral sensitivity of the color correction layer is at 550 nm and the layer contains a development inhibitor releasing compound as in Example 4.

The extent of the reduction in the contrast of the red record when the color correction layer is present is another indication of the effectiveness of this invention. The following table summarizes the contrast reduction of the red record versus the gelatin-only interlayer.

TABLE D

| Contrast Change in Red Record Caused by Color Correction Layer | | | | |
|---|---|---|---|---|
| Example | CCL Location | Peak Sensitivity | DIR | % Change |
| 2 | Layer 4 | 580 nm | No | −5.4 |
| 3 | Layer 4 | 580 nm | Yes | −15.1 |
| 4 | Layer 4 | 550 nm | Yes | −14.7 |
| 5 | Between Layers 2 and 3 | 580 nm | Yes | −18.1 |

Thus both the spectral filtration that is possible for CCL emulsions with absorption peaks in the 550 nm to 620 run wavelength range and the incorporation of colorless development inhibitor releasing compounds or low color DIRs such that the dye density from the CCL is less than 10% of the total dye density can lower the spectral sensitivity of the red-light sensitive record in this unwanted absorption region.

As demonstrated by the examples with reference to the figures and Table D, the use of a color correction layer (CCL) according to the invention in a photographic element reduces the unwanted green-sensitivity of the red record of the element. Accordingly, such a photographic element has faithful color rendition in accordance with the object of the invention.

The following example further illustrates the invention. The constituents used in Example 6 are setout in Table E which follows.

Example 6

A three color photographic film was prepared as follows using conventional surfactants, and antifoggants and the materials indicated. After providing a developable image and then processing in accordance with the Kodak C-41 process (British Journal of Photography, pp. 196–198(1988)) excellent results were obtained.

| Support | mg/dm$^2$ | |
|---|---|---|
| Layer 1 Antihalation layer | 1.4 | Black filamentary silver |
| | 1.6 | oxidized developer (D-OX) scavanging coupler (1) |
| | 0.5 | Magenta filter dye (1) |
| | 0.1 | Cyan filter dye (2) |
| | 0.5 | Magenta dye forming coupler (2) |
| | 0.75 | UV absorbing dye (8) |
| | 24 | Gelatin. |
| Layer 2 First red layer | 6.1 | Slow Ag Br/I emulsion containing 1.3 mole % iodide and 55 mg of sensitizing dye (1) and 693 mg of sensitizing dye (2) per mole of silver halide. |
| | 6.6 | Slow Ag Br/I Tabular grain("T-grain") emulsion containing 3 mole % iodide and 57 mg of sensitizing dye (1) and 689 mg of sensitizing dye (2) per mole of silver halide. |
| | 4.5 | Cyan dye forming coupler (3) |
| | 0.5 | Cyan dye forming development inhibitor releasing coupler ("DIR") (4). |
| | 0.5 | Cyan dye forming couplers (5) |
| | 0.05 | Cyan filter dye (4) |
| | 26.9 | Gelatin |
| Layer 3 Second Red Layer | 8.6 | Fast Ag Br/I T-Grain emulsion containing 3 mole % iodide and 55 mg of sensitizing dye (1) and 691 mg of sensitizing dye (2) per mole of silver halide. |
| | 1.2 | Cyan dye forming coupler (3) |
| | 0.4 | Cyan dye forming coupler (6) |
| | 0.3 | Cyan dye forming DIR coupler (4) |
| | 17.2 | Gelatin |
| Layer 4 Color Corr. Layer | 2.7 | Fast Ag Br/I T-grain emulsion containing 3 mole % iodide and 510 mg of sensitizing dye (3) and 145 mg of sensitizing dye (4) per mole of silver-halide. |
| | 0.3 | Magenta dye forming DIR coupler (7) |
| | 0.14 | Orange filter dye (5) |
| | 7.5 | Gelatin |
| Layer 5 Interlayer | 6.5 | Gelatin |
| Layer 6 First Green Layer | 5.6 | Slow Ag Br/I emulsion containing 1.3 mole % iodide and 510 mg of sensitizing dye (3) and 145 mg of sensitizing dye (4) per mole of silver halide |
| | 5.6 | Slow Ag Br/I T-grain emulsion containing 1.5 mole % iodide and 510 mg of sensitizing dye (3) and 145 mg of sensitizing dye (4) per mole of silver halide |
| | 4.4 | Fast Ag Br/I T-grain emulsion containing 3 mole % iodide and 575 mg of sensitizing dye (3) and 160 mg of sensitizing dye (4) per mole of silver halide |
| | 2.3 | Magenta dye forming coupler (8) |
| | 1.8 | Magenta dye forming coupler (9) |
| | 0.2 | Magenta dye forming DIR coupler (7) |
| | 0.03 | Cyan dye forming coupler (5) |
| | 0.1 | Magenta filter dye (6) |
| | 21.2 | Gelatin |
| Layer 7 Second Green Layer | 7.5 | Fast Ag Br/I T-grain emulsion containing 3 mole % iodide and 575 mg of sensitizing dye (3) and 160 mg of sensitizing dye (4) per mole of silver halide |
| | 0.8 | Magenta dye forming coupler (8) |
| | 0.3 | Magenta dye forming (DIR) coupler (7) |
| | 0.03 | Cyan dye forming coupler (5) |
| | 14.0 | Gelatin |
| Layer 8 Yellow Coll. Silver Filter Layer | 0.5 | D-Ox scavanging coupler (1) |
| | 8.6 | Gelatin |
| Layer 9 First Blue Layer | 1.2 | Slow Ag Br/I emulsion containing 1.3 mole % iodide and 808 mg of sensitizing dye (5) per mole of silver halide |
| | 5.1 | Slow Ag Br/I emulsion containing 3 mole % iodide of 383 mg of sensitizing dye (5) per mole of silver halide. |
| | 3.8 | Yellow dye forming coupler (10) |
| | 9.1 | Yellow dye forming coupler (11) |
| | 0.6 | Yellow dye forming DIR coupler (12) |
| | 21.5 | Gelatin |
| Layer 10 Second Blue Layer | 6.5 | Fast Ag Br/I emulsion containing 7.5 mole % of iodide and 383 mg of sensitizing dye (5) per mole of silver halide. |
| | 1.4 | Yellow dye forming coupler (11) |
| | 0.8 | Yellow dye forming (DIR) coupler (12) |
| | 0.05 | Cyan dye forming coupler (5) |
| | 0.8 | Yellow filter dye (7) |
| | 9.7 | Gelatin |
| Layer 11 | 2.1 | Lippman Ag Br emulsion |
| | 1.1 | UV absorbing dye (3) |
| | 1.1 | UV absorbing dye (8) |
| | 7.0 | Gelatin |
| Layer 12 Protective Gel Overcoat | 8.8 | Gelatin |

TABLE E

Couplers

TABLE E-continued
1)
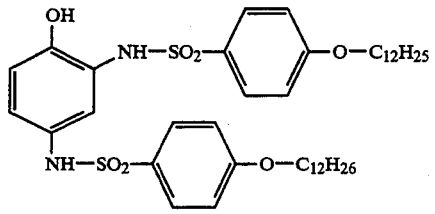
2)
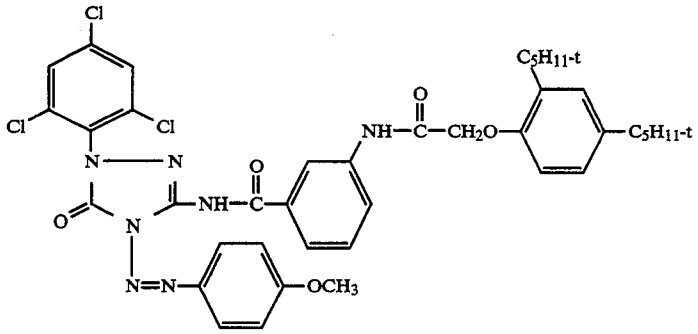
3)
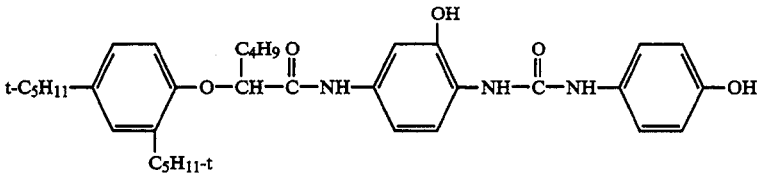
4)
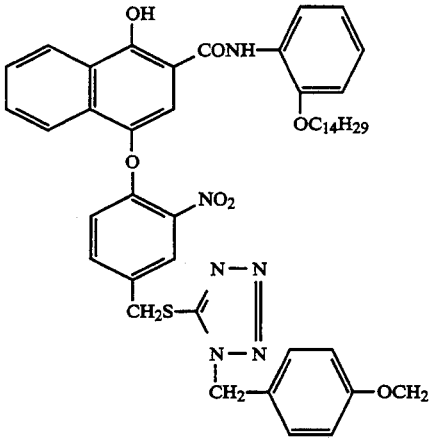
5)
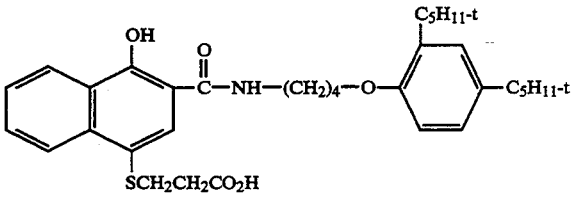

TABLE E-continued
6)
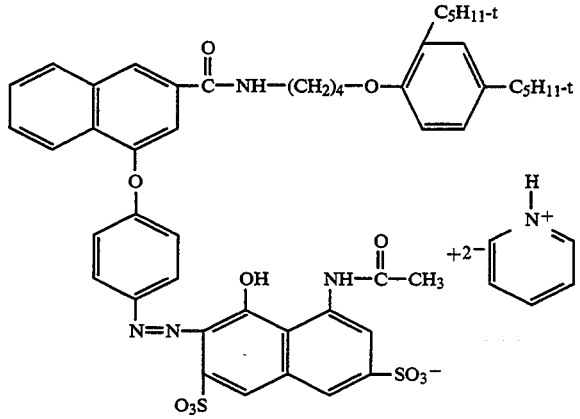
7)
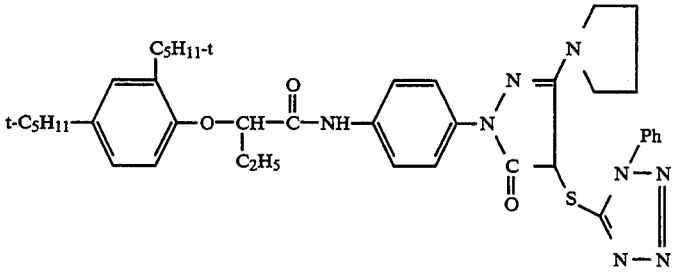
8)
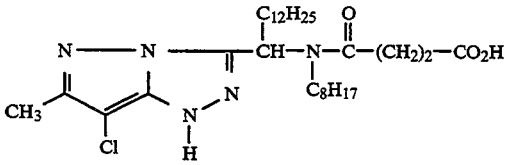
9)
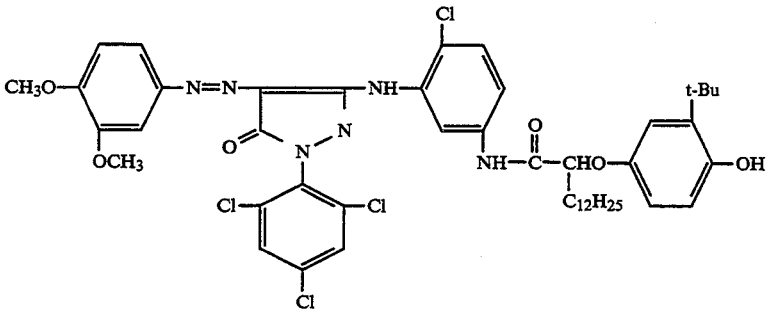
10)
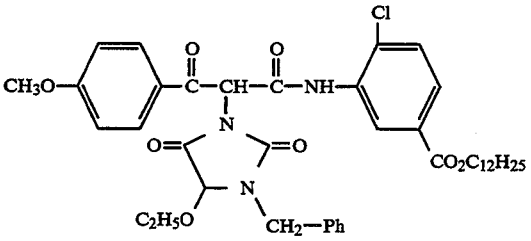
11)
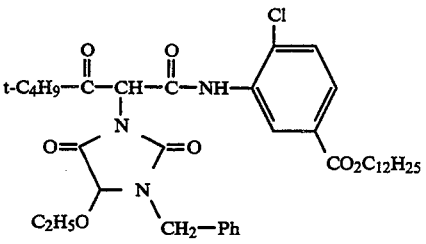

TABLE E-continued
12)
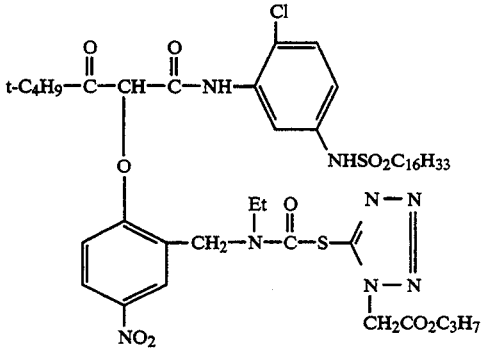
Dyes
(1)
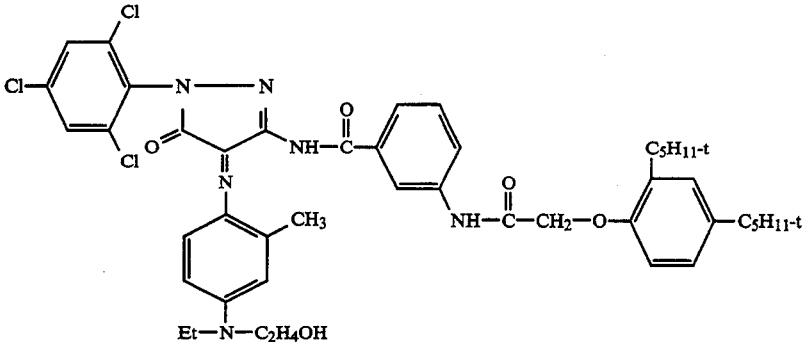
(2)
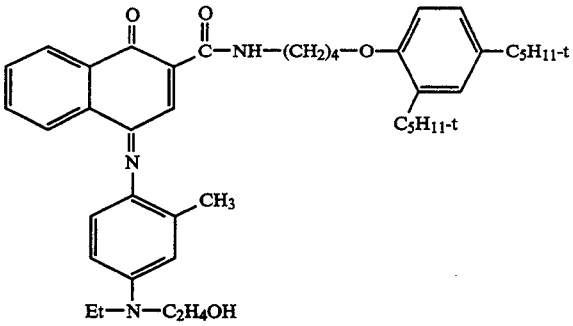
(3)
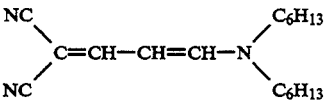
(4) 4,8-bis-(SULFOMETHYLAMINO)-ANTHRARUFIN-2,6-DISULFONIC ACID, TETRASODIUM SALT
(5)
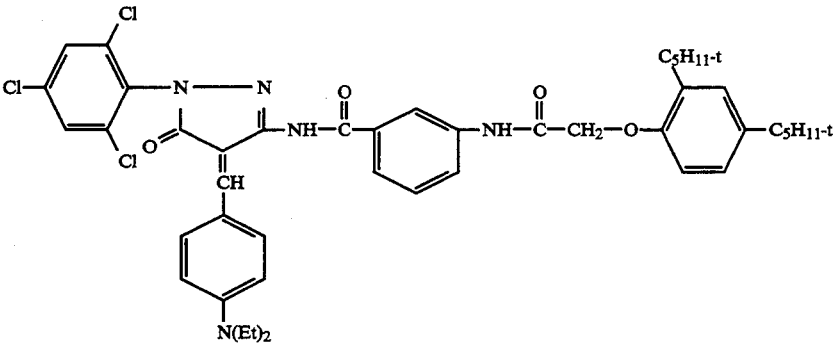

TABLE E-continued
(6)
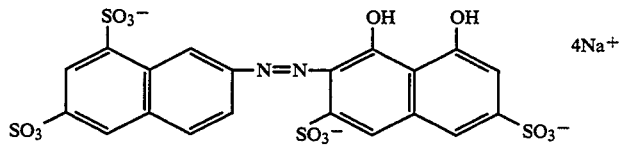
(7)
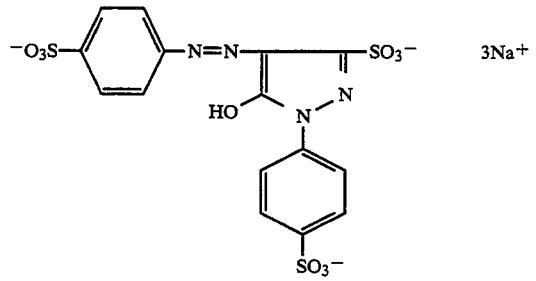
(8)
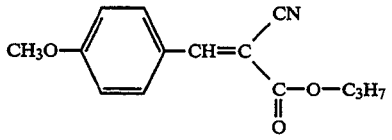
Sensitizing Dyes
(1)
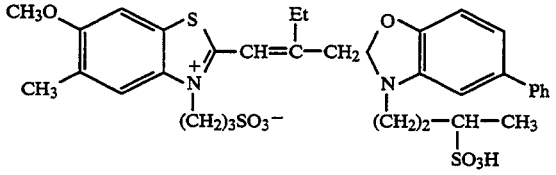
(2)
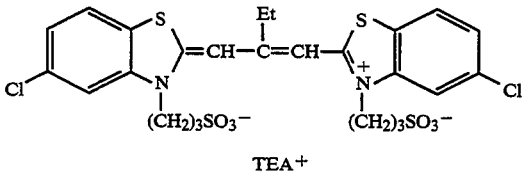
(3)
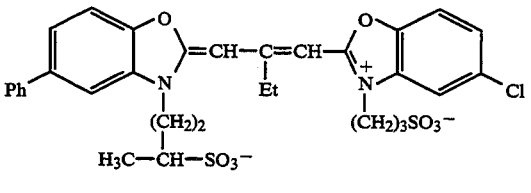
(4)
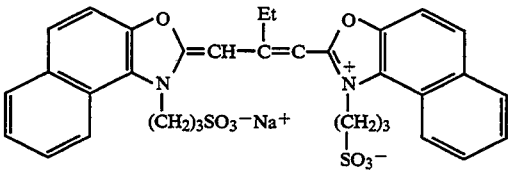
(5)
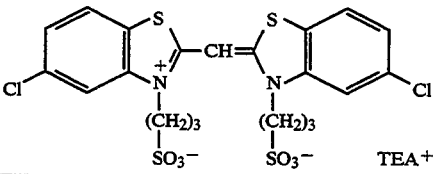
The invention has been described with reference to certain preferred embodiments thereof, but it will be

What is claimed is:

1. A color photographic element comprising:

a) a support bearing a fast photographic silver halide cyan image dye-forming layer and a slow photographic silver halide cyan image dye-forming layer, wherein the slow layer is closer to the support than the fast layer, and b) a color correction layer substantially free of image dye-forming coupler and comprising a spectrally and chemically sensitized photographic silver halide having a maximum absorbance wavelength in the range of about 560 to about 620 nanometers, wherein said color correction layer is between said fast and slow cyan image dye-forming layers.

2. A color photographic element of claim 1, wherein said color correction layer further comprises a development inhibitor releasing compound.

3. A color photographic element of claim 2, wherein the level of said development inhibitor releasing compound ranges from about 0.011 to about 0.269 g/m$^2$.

4. A color photographic element of claim 3, wherein the level of said development inhibitor releasing compound ranges from about 0.011 to about 0.108 g/m$^2$.

5. A color photographic element of claim 1, wherein said development inhibitor releasing compound is of the formula:

CAR-LINK-PUG or CAR-PUG wherein

PUG is a releasable group which acts as a development inhibitor during processing, CAR is a carrier moiety that, upon reaction with oxidized color developing agent is capable of releasing LINK-PUG, or PUG and LINK is a timing group which is releasable from CAR during photographic processing and subsequently releases PUG.

6. A color photographic element of claim 2, wherein said development inhibitor releasing compound comprises a compound of the formula:

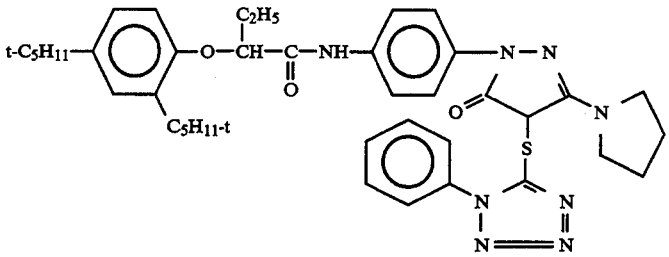

D-1

7. A color photographic element of claim 2, wherein said development inhibitor releasing compound comprises a development inhibitor releasing coupler.

8. A color photographic element of claim 1, wherein the silver halide of said color correction layer comprises about 70 to 100 mole percent of silver bromide, and about 30 to 0 mole percent of silver iodide, the percentages based on total percent of silver halide.

9. A multicolor photographic element comprising a support bearing a cyan dye image-forming unit comprising at least two red-sensitive silver halide emulsion layers having associated therewith at least one cyan dye-forming couplers, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, and a color correction layer substantially free of image dye-forming coupler and comprising a spectrally and chemically sensitized photographic silver halide having a maximum absorbance wavelength in the range of about 560 to about 620 nanometers wherein said cyan dye image-forming unit comprises fast and a slow red-sensitive silver halide emulsion layer, said magenta dye image-forming unit comprises a fast and a slow green-sensitive silver halide emulsion layer, and said yellow dye image-forming unit comprises a fast and a slow blue-sensitive silver halide emulsion layer, wherein in each of said units, the slow layer is closer to the support than the fast layer, and wherein said magenta dye image-forming unit is located between the cyan dye image-forming unit and the yellow dye image-forming unit and wherein the cyan dye-image forming unit is closer to the support than the other two units, and wherein said color correction layer is between said fast and said slow red-sensitive silver halide emulsion layers.

10. A multicolor photographic element of claim 9, wherein said color correction layer comprises a development inhibiting releasing compound.

11. A process for developing an image in a photographic element according to claim 1, said process comprising the steps of imagewise exposing said element to light and developing the exposed element with a silver halide color developing agent.

12. A process for developing an image in a photographic element according to claim 2, said process comprising the steps of imagewise exposing said element to light and developing the exposed element with a silver halide color developing agent.

13. A color photographic element of claim 1, wherein the color correction layer has a maximum absorbance wavelength in the range of about 570 to about 620.

14. A color photographic element of claim 9, wherein the color correction layer has a maximum absorbance wavelength in the range of about 570 to about 600.

15. A color photographic element of claim 1, wherein the color correction layer comprises about 0.011 to about 1.08 g/m$^2$ of silver halide emulsion.

16. A color photographic element of claim 1, wherein the color correction layer is adjacent to both of said fast and slow cyan image dye-forming layers.

17. A color photographic element of claim 1, wherein the color correction layer is located between the fastest cyan image dye-forming layer and the next fastest cyan image dye-forming layer.

18. A color photographic element of claim 1, wherein the color correction layer is located between and adjacent to both the fastest cyan image dye-forming layer and the next fastest cyan image dye-forming layer.

* * * * *